US007603775B2

(12) United States Patent
Meng et al.

(10) Patent No.: US 7,603,775 B2
(45) Date of Patent: Oct. 20, 2009

(54) HEAT SPREADER WITH VAPOR CHAMBER AND METHOD OF MANUFACTURING THE SAME

(75) Inventors: Jin-Gong Meng, Shenzhen (CN); Ching-Bai Hwang, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 35 days.

(21) Appl. No.: 11/686,937

(22) Filed: Mar. 15, 2007

(65) Prior Publication Data

US 2008/0087405 A1 Apr. 17, 2008

(30) Foreign Application Priority Data

Oct. 11, 2006 (CN) ..... 2006 1 0063036

(51) Int. Cl.
*B23P 6/00* (2006.01)
*F28D 15/00* (2006.01)

(52) U.S. Cl. ..... 29/890.032; 165/104.26; 165/104.33

(58) Field of Classification Search ..... 29/890.032, 29/458, 460; 165/104.26, 104.33, 133
See application file for complete search history.

(56) References Cited

U.S. PATENT DOCUMENTS 5,642,776 A 7/1997 Meyer, IV et al.
6,027,630 A * 2/2000 Cohen ..... 205/135
6,679,318 B2 1/2004 Bakke
7,160,429 B2 * 1/2007 Cohen et al. ..... 205/220
7,219,715 B2 * 5/2007 Popovich ..... 165/80.4
2002/0092166 A1 * 7/2002 Jacobs et al. ..... 29/890.032
2006/0137862 A1 * 6/2006 Huang et al. ..... 165/104.33
2006/0141675 A1 * 6/2006 Hwang et al. ..... 438/124
2007/0006993 A1 * 1/2007 Meng et al. ..... 165/104.26
2007/0017814 A1 * 1/2007 Hwang et al. ..... 205/118

FOREIGN PATENT DOCUMENTS

CN 86105307 A 4/1987
CN 1797754 A 7/2006

* cited by examiner

*Primary Examiner*—David P Bryant
*Assistant Examiner*—Ryan J Walters
(74) *Attorney, Agent, or Firm*—Frank R. Niranjan

(57) ABSTRACT

A heat spreader (100) includes a metal casing (60) formed by electrodeposition and defining a vapor chamber (40) therein, and a mesh (12*b*) lining an inner surface of the metal casing. A method for manufacturing the heat spreader includes: providing a core (60*a*) having a mesh layer (12*a*) including a plurality of pores and a filling material (14) filled in the pores of the mesh layer and a major space enclosed by the mesh layer; electrodepositing a layer of metal coating (60*b*) on an outer surface of the core; removing the filling material from the coating layer and the pores of the mesh layer; and filling a working fluid into the coating layer and hermetically sealing the coating layer to thereby obtain the heat spreader with therein a wick structure (12) formed by the mesh layer and the vapor chamber formed by said major space.

6 Claims, 6 Drawing Sheets

HEAT SPREADER WITH VAPOR CHAMBER AND METHOD OF MANUFACTURING THE SAME

BACKGROUND OF THE INVENTION

1. Field of the Invention

The present invention relates to an apparatus for transfer or dissipation of heat from heat-generating components, and more particularly to a heat spreader having a vapor chamber of a complicated configuration and a method of manufacturing the heat spreader.

2. Description of Related Art

It is well known that heat is generated during operations of a variety of electronic components, such as integrated circuit chips. To ensure normal and safe operations, cooling devices such as heat sinks and/or electric fans are often employed to dissipate the generated heat away from these electronic components.

As progress continues to be made in the electronics art, more components on the same real estate generate more heat. The heat sinks used to cool these chips are accordingly made larger in order to possess a higher heat removal capacity, which causes the heat sinks to have a much larger footprint than the chips. Generally speaking, a heat sink is more effective when there is a uniform heat flux applied over an entire base of the heat sink. When a heat sink with a large base is attached to an integrated circuit chip with a much smaller contact area, there is significant resistance to the flow of heat to the other portions of the heat sink base which are not in direct contact with the chip.

A mechanism for overcoming the resistance to heat flow in a heat sink base is to attach a heat spreader to the heat sink base or directly make the heat sink base as a heat spreader. Typically, the heat spreader includes a vacuum vessel defining therein a vapor chamber, a wick structure provided in the chamber and lining an inside wall of the vessel, and a working fluid contained in the wick structure. As an integrated circuit chip is maintained in thermal contact with the heat spreader, the working fluid contained in the wick structure corresponding to a hot contacting location vaporizes. The vapor then spreads to fill the chamber, and wherever the vapor comes into contact with a cooler surface of the vessel, it releases its latent heat of vaporization and condenses. The condensate returns to the hot contacting location via a capillary force generated by the wick structure. Thereafter, the condensate frequently vaporizes and condenses to form a circulation to thereby remove the heat generated by the chip. In the chamber of the heat spreader, the thermal resistance associated with the vapor spreading is negligible, thus providing an effective means of spreading the heat from a concentrated source to a large heat transfer surface.

Conventionally, the wick structure of the heat spreader is a grooved or sintered type. However, in view of traditional manufacturing processes, it is difficult to manufacture a heat spreader having a complicated configuration since it is difficult to carve tiny grooves or sinter complicated porous structures in an inner surface of a complicated configuration. Thus, the heat spreader can not be used in a complicated system, which causes the heat generated by the chips of the complicated system can not be timely removed. Therefore, it is desirable to provide a method of manufacturing a heat spreader which may have a complicated configuration.

SUMMARY OF THE INVENTION

The present invention relates, in one aspect, to a method for manufacturing a heat spreader. The method for manufacturing a heat spreader includes: providing a core, the core having a mesh including a plurality of pores and a filling material filled in the pores of the mesh and a major space enclosed by the mesh; electrodepositing a layer of metal coating on an outer surface of the core; removing the filling material from the coating layer and the pores of the mesh; and filling a working fluid into the coating layer and hermetically sealing the coating layer to thereby obtain the heat spreader with therein a wick structure formed by the mesh and a vapor chamber formed by said major space. By this method, the heat spreader is easily made to have a complicated configuration. Also, the mesh is integrally formed with the metal casing of the heat spreader as a single piece, which decreases the heat resistance therebetween and thereby increasing heat removal capacity of the heat spreader.

The present invention relates, in another aspect, to a heat spreader applicable for removing heat from a heat-generating component. The heat spreader includes a metal casing formed by electrodeposition and defining a chamber therein, and a mesh lining an inner surface of the metal casing. The mesh is integrally formed with the metal casing of the heat spreader as a single piece, which decreases the heat resistance therebetween and thereby increasing heat removal capacity of the heat spreader.

Other advantages and novel features of the present invention will become more apparent from the following detailed description of preferred embodiments when taken in conjunction with the accompanying drawings, in which:

DETAILED DESCRIPTION OF THE INVENTION

Figure 1:
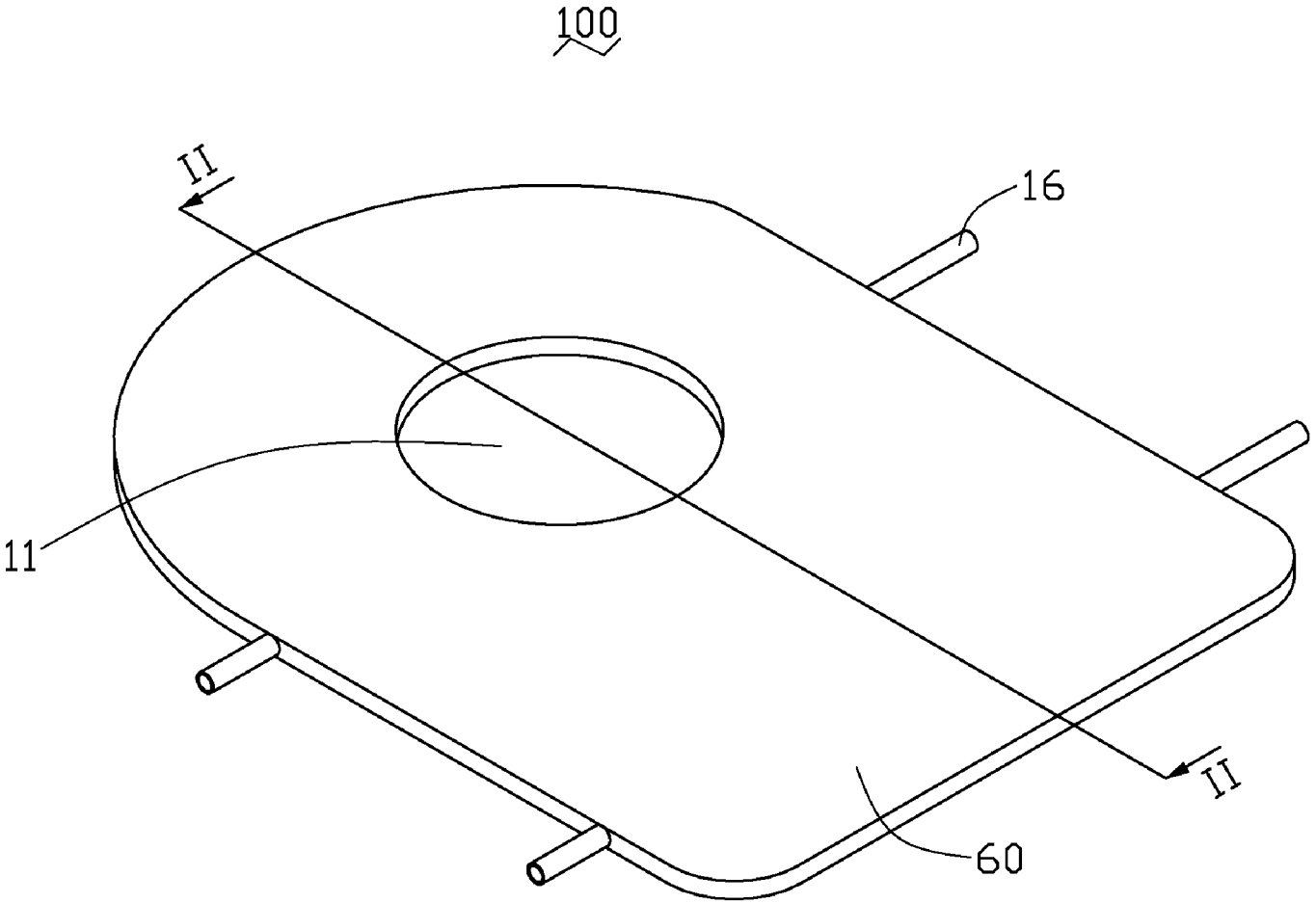
FIG. 1 is an isometric view of a heat spreader in accordance with a preferred embodiment of the present invention.
Figure 2:
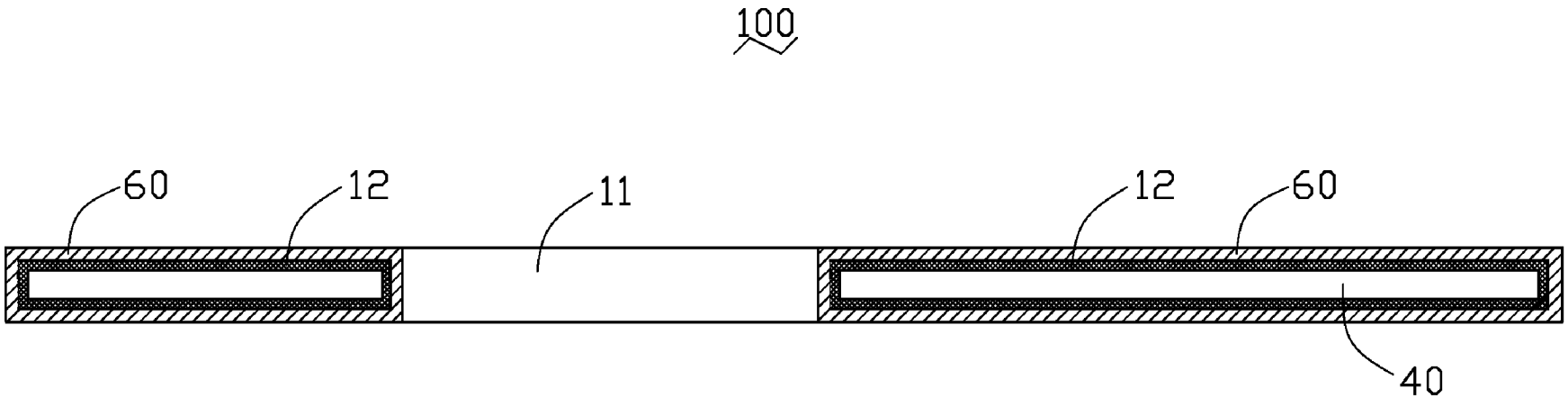
FIG. 2 is a cross-sectional view of the heat spreader of FIG. 1, taken along line II-II thereof.

FIGS. 1 and 2 illustrate a heat spreader 100 formed in accordance with a method of the present invention. The heat spreader 100 is integrally formed and has a flat type configuration. The heat spreader 100 includes a metal casing 60 with a chamber 40 defined therein. A round hole 11 is defined in a middle portion of the metal casing 60 for location of a heat dissipating fan such as a centrifugal blower (not shown). A wick structure 12 is arranged in the chamber 40, lining an inner surface of the metal casing 60 and occupying a portion of the chamber 40. The other portion of the chamber 40, which is not occupied by the wick structure 12 functions as a vapor-gathering region. The metal casing 60 is made of high thermally conductive material such as copper or aluminum. The heat spreader 100 has four open ends 16 extending from two opposite sides thereof, respectively. A working fluid (not shown) is injected into the chamber 40 through the ends 16 and then the heat spreader 100 is evacuated and the ends 16 are hermetically sealed. The working fluid filled into the chamber 40 is saturated in the wick structure 12 and is usually selected from a liquid such as water or alcohol which has a low boiling point and is compatible with the wick structure 12.

In operation, the heat spreader 100 may function as an effective mechanism for evenly spreading heat coming from a concentrated heat source (not shown) to a large heat-dissipating surface. For example, a bottom wall of the heat spreader 100 is maintained in thermal contact with the heat source, and a top wall of the heat spreader 100 may be directly attached to a heat sink base (not shown) having a much larger footprint than the heat source in order to spread the heat of the heat source uniformly to the entire heat sink base. Alternatively, a plurality of metal fins may also be directly attached to the top wall of the heat spreader 100. The working fluid saturated in the wick structure 12 of the heat spreader 100 evaporates upon receiving the heat generated by the heat source. The generated vapor enters into the vapor-gathering region of the chamber 40. Since the thermal resistance associated with the vapor spreading in the chamber 40 is negligible, the vapor then quickly moves towards the cooler top wall of the heat spreader 100 through which the heat carried by the vapor is conducted to the entire heat sink base or the metal fins attached to the heat spreader 100. Thus, the heat coming from the concentrated heat source is transferred to and uniformly distributed over a large heat-dissipating surface (e.g., the heat sink base or the fins). After the vapor releases the heat, it condenses and returns to the bottom wall of the heat spreader 100 via a capillary force generated by the wick structure 12.

Figure 3:
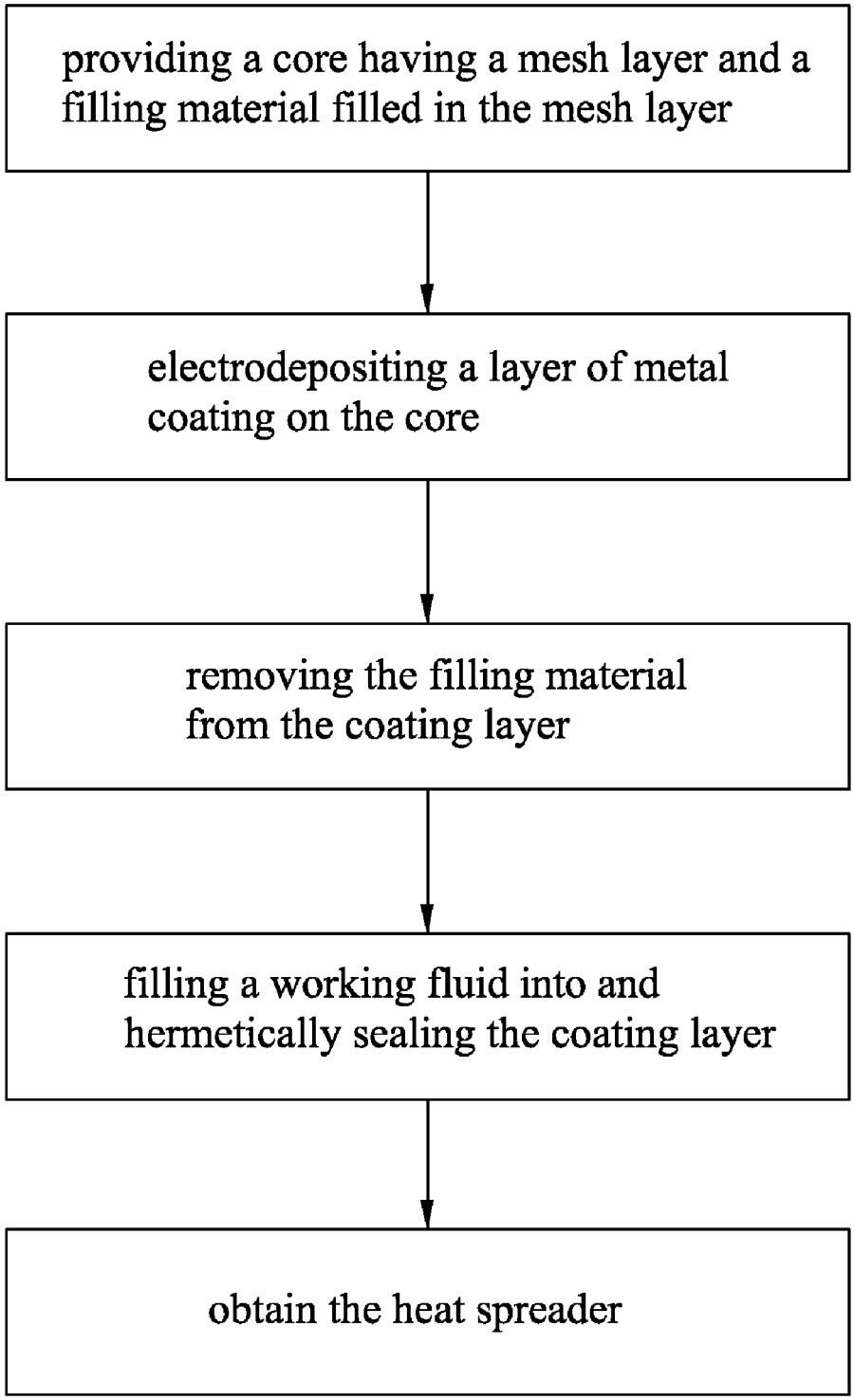
FIG. 3 is a flow chart showing a preferred method of the present invention for manufacturing the heat spreader of FIG. 1.
Figure 4:
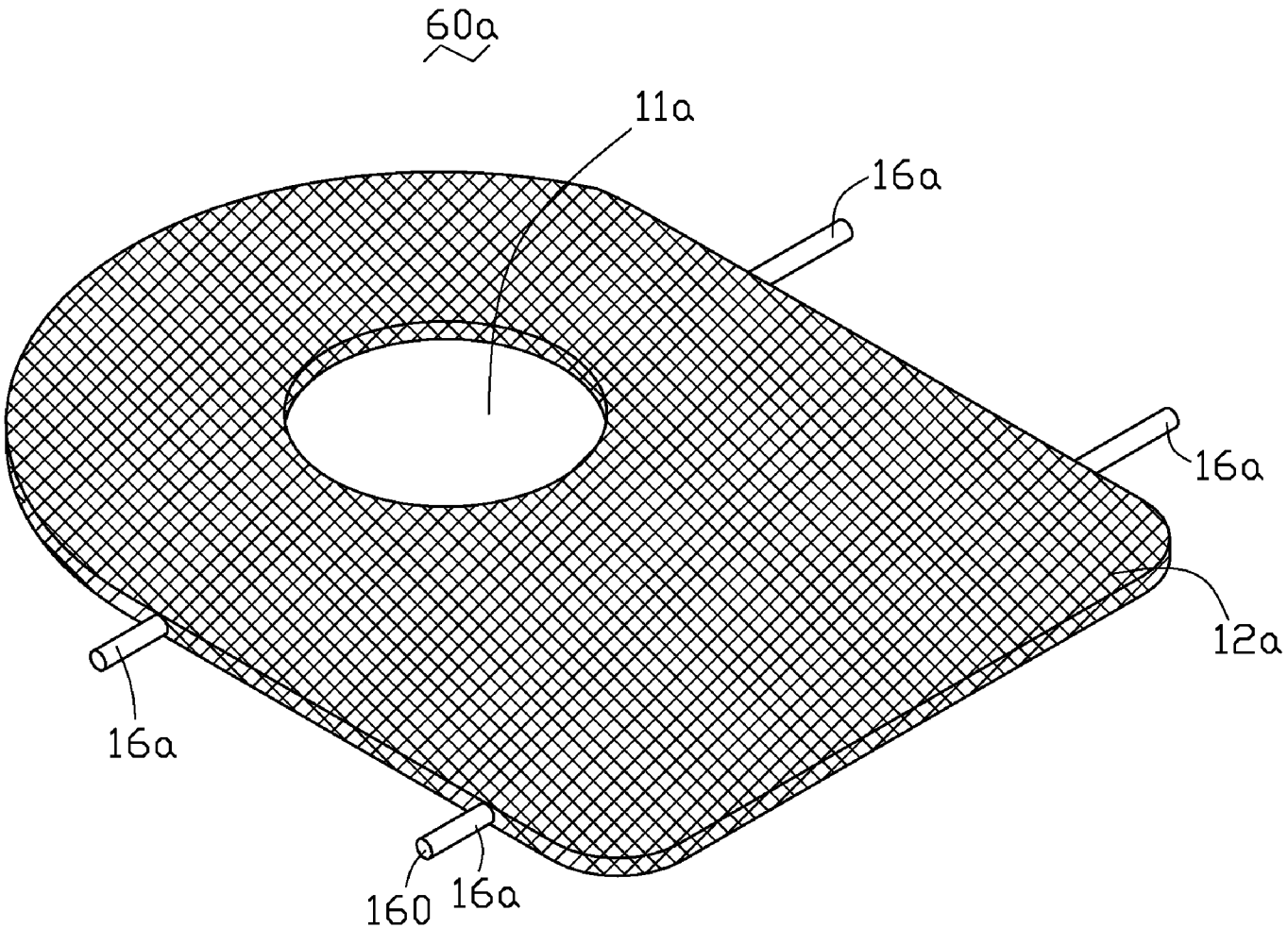
FIG. 4 is an isometric view of a core for being electrodeposited with a layer of metal coating on an outer surface thereof to manufacture the heat spreader of FIG. 1.

As shown in FIG. 3, a method is proposed to manufacture the heat spreader 100. More details about the method can be easily understood with reference to FIGS. 4-6. Firstly, a core 60*a* is provided with a round hole 11*a* defined in a middle portion and four columns 16*a* extending from two opposite ends thereof, as shown in FIG. 4. The core 60*a* is to form the metal casing 60 of the heat spreader 100 and has a configuration substantially the same as that of the metal casing 60. The core 60*a* has a mesh layer 12*a* to form the wick structure 12 of the heat spreader 100, and a filling material 14 filled in a major space and pores of the mesh layer 12*a*. The filling material 14 binds with the mesh layer 12*a*.

Figure 5:
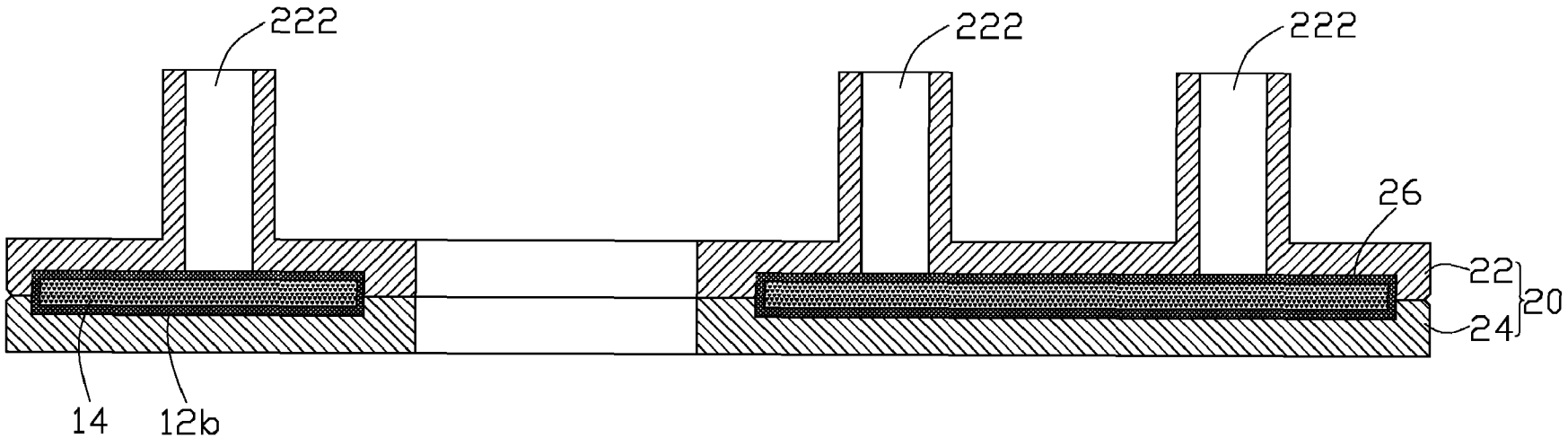
FIG. 5 is a schematic, cross-sectional view of a mold applied for lining a mesh and filling a filling material therein to manufacture the core of FIG. 4.

Referring to FIG. 5, a mold 20 including a first mold 24 and a second mold 22 is provided in order to manufacture the core 60*a*. The second mold 22 covers and cooperatively forms a cavity 26 with the first mold 24. The cavity 26 of the mold 20 has a configuration substantially the same as that of the core 60*a* to be formed and includes four columned tubes (not shown) for formation of the columns 16*a* of the core 60*a*. A layer of woven mesh 12*b* is arranged in the cavity 26, lining an inner surface of the cavity 26 of the mold 20 for formation of the mesh layer 12*a* of the core 60*a*. The mesh 12*b* is woven by a plurality of flexible metal wires, such as copper wires or stainless steel wires so that the mesh 12*b* has an intimate contact with the inner surface of the cavity 26 of the mold 20. Alternatively, the mesh 12*b* may also be woven by a plurality of flexible fiber wires. A molten or liquid filling material 14 then is filled into the cavity 26 and the pores of the mesh 12*b* via filling tubes 222 defined at the top of the second mold 22. The filling material 14 is selected from such materials that can be easily removed after the heat spreader 100 is formed. For example, the filling material 14 may be paraffin or some kind of plastic or polymeric material or alloy that is liquefied when heated. Alternatively, the filling material 14 may also be selected from gypsum or ceramic that is frangible after solidified. The filling material 14 solidifies in the cavity 26 and binds with the mesh 12*b* when it is cooled. After the filling material 14 in the cavity 26 is solidified, the mold 20 is removed. As a result, the pores of the mesh 12*b* and the cavity 26 of the mold 20 are filled with the filling material 14 and the core 60*a* is obtained. The columns 16*a* of the core 60*a* are simultaneously formed by the filling material 14 filled in the columned tubes of the mold 20.

Figure 6:
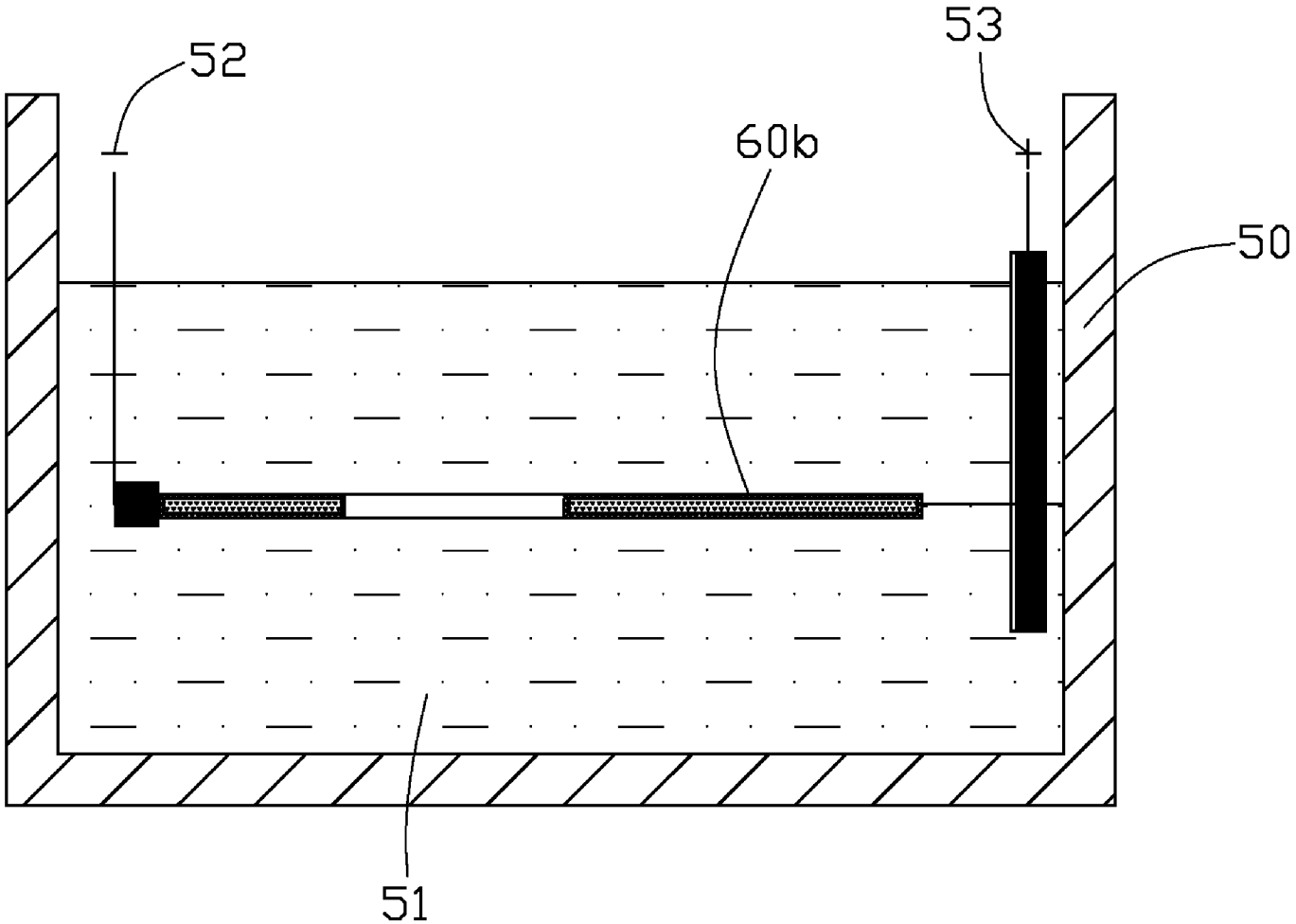
FIG. 6 is a schematic, cross-sectional view of an electrodeposition bath for electrodepositing the layer of metal coating on the outer surface of the core of FIG. 4.

Thereafter, the method, as shown in FIG. 3, includes an electrodeposition step in order to form the metal casing 60 of the heat spreader 100. In order to proceed with the electrodeposition, an electrically conductive layer (not shown) is coated on an outer surface of the core 60*a* filled with the filling material 14, whereby the outer surface of the core 60*a* is conductive. In order to keep the ends 16 of the heat spreader 100 open, there is no electrically conductive layer coated on free ends 160 of the columns 16*a* of the core 60*a*. Then, the core 60*a* with the solidified filling material 14 contained therein is disposed into an electrodeposition bath 50 which contains an electrolyte 51, as shown in FIG. 6. The electrodeposition bath 50 includes an anode 53 and a cathode 52 both of which are immersed in the electrolyte 51 with the cathode 52 connecting with the core 60*a*. After electrodepositing for a specific period of time, the core 60*a* is taken out of the electrodeposition bath 50 and a layer of metal coating (coating layer 60*b*) is accordingly formed on the outer surface of the core 60*a*, as shown in FIG. 6.

Then, the liquefiable filling material 14 in the core 60*a* is removed away from the mesh layer 12*a* of the core 60*a* and the coating layer 60*b* by heating the filling material 14 at a temperature above a melting temperature of the filling material 14. The frangible filling material 14 is removed from the core 60*a* and the coating layer 60*b* by vibrating the filling material 14. The filling material 14 is removed from the mesh layer 12*a* of the core 60*a* and the coating layer 60*b* via the ends 16 formed by the coating layer 60*b* after the electrodeposition step. After the filling material 14 is completely removed, a semi-manufactured heat spreader is obtained. Thereafter, an inner space of the semi-manufactured heat spreader is cleaned and the working fluid is injected into the metal casing 60 to be saturated in the wick structure 12. Finally, the metal casing 60 is vacuumed and the ends 16 are sealed and the heat spreader 100 is obtained.

According to the method, the wall thickness of the heat spreader 100 can be easily controlled by regulating the time period and voltage involved in the electrodeposition step. The wick structure 12 is integrally formed with the metal casing 60 of the heat spreader 100 as a single piece by electroforming, which decreases the heat resistance therebetween and thereby increasing heat removal capacity of the heat spreader 100. Since the metal casing 60 of the heat spreader 100 is formed by electroforming, the heat spreader 100 is easily made to have a complicated configuration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for forming a heat spreader having a vapor chamber, comprising:

providing a mold having an inner space with an inner surface;

lining a mesh on the inner surface of the mold;

injecting a filling material into the inner space of the mold so that the filling material fills a space within the mesh and binds with the mesh, whereby a core is obtained;

removing the core from the mold;

coating a layer of metal on an outer surface of the core by electrodeposition such that the core is encased within the metal coating layer;

removing the filling material from the core, leaving only the mesh encased within the metal coating layer; and filling a working fluid into and hermetically sealing the mesh, wherein the mesh encased within the metal coating layer is left as a wick structure for the heat spreader.

2. The method as described in claim 1, wherein the filling material is chosen from one of paraffin, plastic material and polymeric material.

3. The method as described in claim 2, wherein the filling material is removed from the core by heating.

4. The method as described in claim 1, wherein the filling material is chosen from one of gypsum and ceramic.

5. The method as described in claim 4, wherein the filling material is removed from the core by vibration.

6. The method as described in claim 1, wherein the mesh is formed by one of metal wires and fabric wires.

* * * * *